US006237184B1

(12) United States Patent
Lenaghan

(10) Patent No.: US 6,237,184 B1
(45) Date of Patent: May 29, 2001

(54) DUSTER FOR PIANOS AND THE LIKE

(76) Inventor: Arlene Lenaghan, 1130 Stanley Blvd., Birmingham, MI (US) 48009

( * ) Notice: Subject to any disclaimer, the term of this patent is extended or adjusted under 35 U.S.C. 154(b) by 0 days.

(21) Appl. No.: 09/347,536

(22) Filed: Jul. 6, 1999

(51) Int. Cl.[7] ..... A47L 13/38; A47L 25/00; G10D 3/00

(52) U.S. Cl. ..... 15/210.1; 15/104.16; 84/453

(58) Field of Search ..... 15/104.16, 104.165, 15/209.1, 210.1, 211, 228, 229.3; 84/453

(56) References Cited

U.S. PATENT DOCUMENTS

| | | | | |
|---|---|---|---|---|
| 782,669 | | 2/1905 | Lea | 15/226 |
| 1,785,512 | * | 12/1930 | Buttenheim | 15/210.1 |
| 2,062,065 | | 11/1936 | Miley | 15/210.1 |
| 2,877,482 | | 3/1959 | Roy | 15/220.3 |
| 3,205,518 | * | 9/1965 | Romaine | 15/104.165 |
| 3,360,818 | * | 1/1968 | Edwards | 15/104.16 |
| 3,671,993 | * | 6/1972 | Smedstad | 15/211 |
| 5,033,155 | | 7/1991 | Klotz | 15/211 |
| 5,555,588 | * | 9/1996 | Viesehon | 15/104.16 |
| 5,598,596 | * | 2/1997 | Jones et al. | 15/209.1 X |

FOREIGN PATENT DOCUMENTS 2182191 5/1987 (GB) .

* cited by examiner

*Primary Examiner*—Mark Spisich
(74) *Attorney, Agent, or Firm*—Palmer C. DeMeo

(57) ABSTRACT

A duster which is flexible in all directions has the ability to dust hard to reach and inaccessible surface areas. One application of the duster is to clean the sound board beneath the strings of a grand or baby grand piano. The core of the duster has an elongated rod which is made from a flexible material and is covered by a close fitting cleaning or dusting sleeve made from napped material, cloth or other well known cleaning or dusting fabric or material.

14 Claims, 2 Drawing Sheets

FIG 1
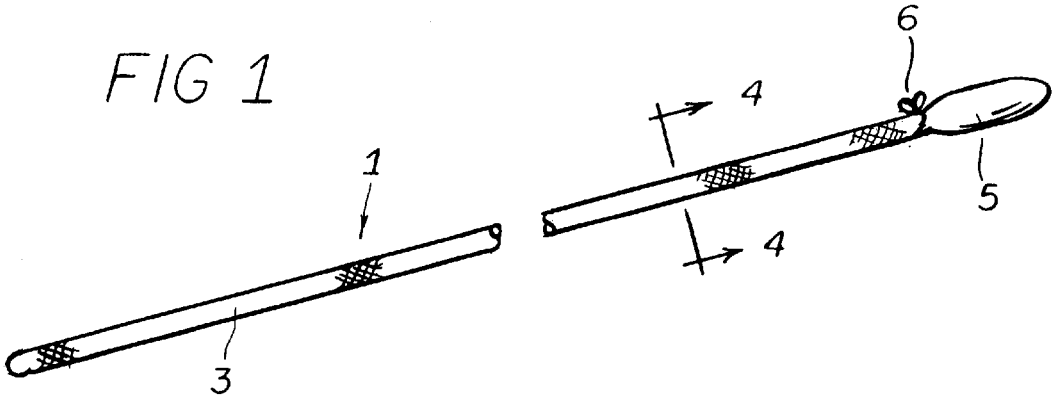
FIG. 2
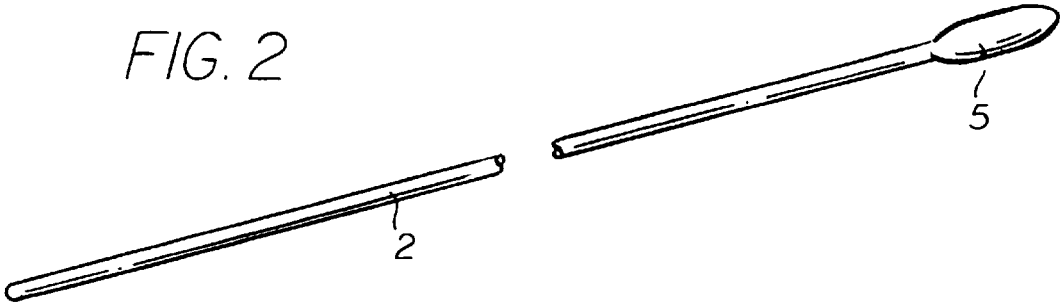
FIG 3
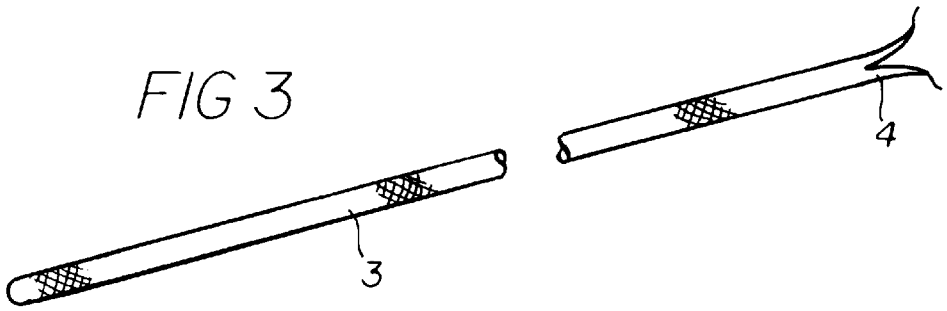
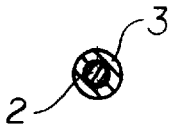
FIG 4

DUSTER FOR PIANOS AND THE LIKE

BACKGROUND OF THE INVENTION

1. Field of the Invention

The invention relates to dusters in general and dusters particularly adaptable to dusting the inside of a piano such as a grand or baby grand piano, especially under the strings and sound holes of pianos.

2. Description of the Related Art

U.S. Pat. No. 2,062,065 (Inventor, M. M. Miley) discloses a cleaning implement which is adapted to clean portions of a piano (such as the sound board under the strings) which portions are inaccessible by using an ordinary brush or mop. The cleaning implement comprises a flat elongated bar of resilient material such as spring steel. The bar is covered with a multi-component cleaning head which includes inner and outer elongated strips of chamois, cloth or the like with strands of soft readily foldable material such as cotton between the strips. The patent specifically states that the elongated bar which has a substantial width is readily flexible in a direction at right angles to its surface but is rigid in a direction parallel with its surface.

SUMMARY OF THE INVENTION

Dusting of surfaces in hard to reach and inaccessible areas is an age-old problem and, particularly, the dusting of the sound board beneath the strings of a piano such as a grand or baby grand piano and the dusting beneath the sound holes of a piano. There have been various dusters that have addressed this problem over the years. One, in particular, the cleaning implement disclosed in the patent of M. M. Miley mentioned above was directed to cleaning the sound board below the strings of a piano such as a grand or baby grand piano. However, the cleaning implement of Miley had some drawbacks. For example, the cleaning implement of Miley is inserted between selected strings of the piano and then swept over the sounding board to clean it. However, when the cleaning implement of Miley is withdrawn from between the strings of the piano, it would appear that dust picked up by the cleaning implement would be dislodged from the cleaning implement when, because of its width, rubbing against the strings during its withdrawal. Furthermore, since the core or bar of the cleaning implement of Miley is constructed to be flexible only in the vertical direction, its maneuverability would be restricted in its cleaning capability. The duster of the present invention overcomes the disadvantages of the prior art since, inter alia, it is constructed of an elongated rod which is flexible in all directions.

It is an object of this invention to provide a duster for cleaning or dusting hard to reach and inaccessible areas.

It is another object of this invention to provide a duster which is particularly adapted to cleaning the sound board beneath the strings of a piano such as a grand or baby grand piano as well as beneath its sound holes.

It is yet another object of this invention to provide a duster which is so constructed as to be omnidirectional in its maneuverability and, therefore, more versatile in its cleaning capabilities.

Other objects, features and advantages of this invention will become more apparent from the following detailed description of the invention as illustrated in the accompanying drawings. The drawings are schematic and not necessarily drawn to scale, emphasis being placed instead on the principles of this invention.

BRIEF DESCRIPTION OF THE DRAWINGS

FIG. 1 is a perspective view of a first embodiment of the duster of this invention.

FIG. 2 is a perspective view of the inner flexible rod with handle of the duster of FIG. 1.

FIG. 3 is a perspective view if the cleaning sleeve removed from the flexible rod of the duster of FIG. 1.

FIG. 4 is a cross-sectional view of the duster taken through 4—4 of FIG. 1.

DESCRIPTION OF THE PREFERRED EMBODIMENTS

Figure 5:
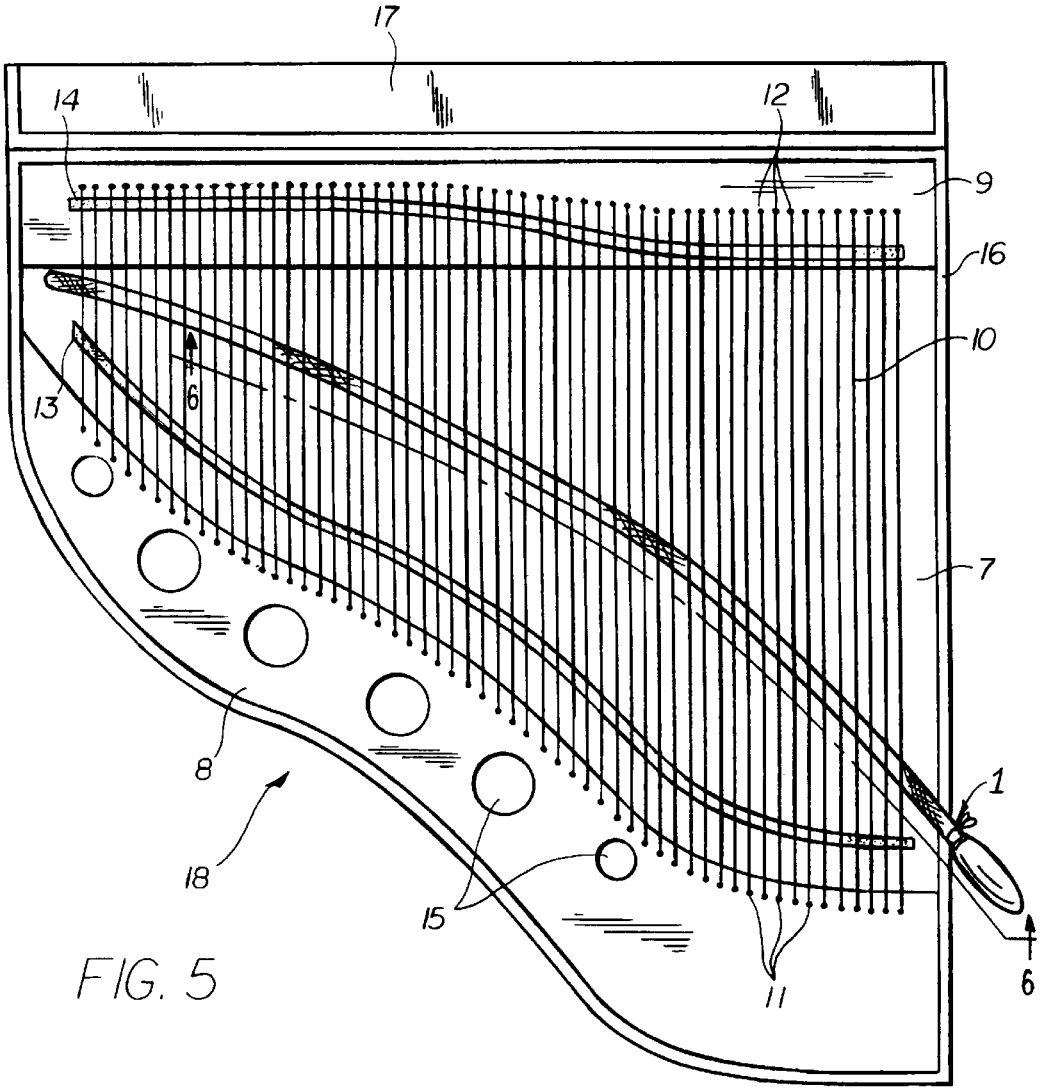
FIG. 5 is a top plan view of a grand or baby grand piano (with its lid or cover removed) showing an application of the duster of this invention.

Referring to FIGS. 1–3, there is shown a first embodiment of the duster of this invention. The duster 1 is constructed of a flexible rod 2 surrounded by a closely fitting cleaning sleeve 3. The flexible rod 2 is constructed of plastic or wound steel; it may also be constructed of wood which is flexible. In a preferred embodiment, the flexible rod is constructed from Delrin plastic (acetal), a type of nylon. The rod 2 is flexible both vertically and laterally and, in effect, omnidirectionally. The rod 2 is covered by a close fitting cleaning sleeve 3 which is made of a napped material, cloth or any other well known cleaning fabric. The cleaning sleeve 3 may be made from a rectangular swatch of material with two edges being sewn together to form a closed end hollow sleeve as shown in FIG. 3. The cleaning sleeve 3 may also be made from electrostatic material well known in the art for its dust attractant property. The overall length of the duster 1 in the first embodiment of this invention is approximately 5 feet to accommodate the cleaning of the sound board of a piano such as a grand or baby grand piano. The overall length of the cleaning sleeve 3 is approximately the same length as the flexible rod 2. The length of the duster 1 may vary depending on the size of the piano or on a particular application. The diameter of the rod 2 is approximately ¼ inch. The cleaning sleeve 3, which has tabs 4 extending from one end thereof, is slipped over the rod 2 and held thereon by tying tabs 4 into a simple bow 6. This simple method of attaching the cleaning sleeve 3 to the flexible rod 2 makes it more readily detachable, removable and replaceable with another cleaning sleeve of different material for other uses such as washing, waxing, oiling, polishing, etc. This simple method of attaching the cleaning sleeve 3 also allows the readily changing of cleaning sleeves with various thicknesses. Alternatively, Velcro (a hook and loop fastener) may also be used to attach the cleaning sleeve 3 to the rod 2 or handle 5. The handle 5 is attached to the rod 2 by any conventional means and may be made from the same material as the rod 2 or from another material which is rigid and sturdy. For examples, the handle 5 may be screwed on one end of the flexible rod 2 or attached thereto by a suitable adhesive. If the flexible rod 2 is made from plastic or metal, then the handle 5 may be molded as one piece with the flexible rod 2. FIG. 4 shows a cross section of the duster in FIG. 1 with the cleaning sleeve 3 surrounding the flexible rod 2.

Referring now to FIG. 5, there is shown one application of the duster 1 of this invention to a grand or baby grand piano 18. The grand or baby grand piano 18 has a conventional keyboard 17 and a frame 16 within which there are support pin plates 8 and 9, a sound board 7, support bridges 13 and 14 (one on the sound board 7 and the other on the support plate 9) and strings 10 attached to the support pins 11 and 12 on respective support plates 8 and 9. Several sound holes 15 are located in the support plate 8. The strings 10 are conventionally spaced less than one inch above the sound board 7. The duster 1 of this invention is inserted in the space between a side wall of the piano frame 16 and the edge of the piano's harp of strings 10, in particular the bass strings, and then beneath the strings 10. The duster 1 is then made to dust the floor of the sound board 7 by easily sweeping it over and around the floor of the sound board 7 up to the contoured, cornered and straight side walls of the piano frame 16. The duster 1 is then withdrawn with the dust clinging to the sleeve 3 of the flexible duster 1. The duster 1 of this invention does not interfere with the piano strings 10 since the thickness of the duster 1 is sufficiently less than the spacing between the piano strings 10 and the sound board 7.

Figure 6:
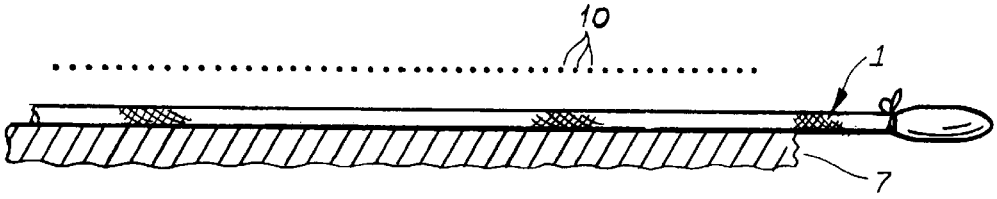
FIG. 6 is a partial cross-sectional view taken through 6—6 of FIG. 5.

FIG. 6 shows the duster 1 of this invention as it is moved or swept over the surface of the sound board 7 below the piano strings 10.

In a second embodiment or mini-version of the duster of this invention, the duster 1 has a rod about ten inches long with a 3/16 inch diameter and has a construction similar to the first embodiment previously described. This second embodiment of the duster 1 of this invention can also be used to dust surfaces in difficult to reach and inaccessible areas but is particularly adapted to dust beneath the sound holes 15 of a grand or baby grand piano. In particular, this mini-version duster 1 is swept down into and around the sound holes 15, bending under the frame of the sound holes 15 and cleaning these difficult surface areas.

Although the duster of this invention is particularly adapted to clean or dust surface areas within the frame of a grand or baby grand piano, it can also be used to clean or dust surface areas within the frame of other types of pianos as well as furniture, appliances, etc.

Modifications of this invention will be readily apparent to those skilled in the art and it is intended that the invention be not limited by the embodiments disclosed herein but that the scope of the invention be defined by the appended claims.

What is claimed is:

1. A duster for cleaning a piano having a soundboard and a set of strings spaced above and closely adjacent said soundboard, said duster comprising:

a) an elongated flexible rod having a circular cross-section throughout its length whereby it is flexible vertically and horizontally, said rod having a length of approximately five feet and a diameter of approximately ¼ inch whereby it is long enough and narrow enough to extend across the soundboard and beneath the set of strings; and b) a cleaning sleeve enclosing said rod, said sleeve having a length substantially the same as said rod.

2. The duster of claim 1 wherein the rod is made from plastic, wound steel or wood.

3. The duster of claim 1 wherein the cleaning sleeve is made from a material selected from the group consisting of napped material, cloth material, and electrostatic material.

4. The duster of claim 1 wherein the cleaning sleeve is tied onto said flexible rod.

5. The duster of claim 1 wherein the rod is flexible omnidirectionally.

6. The duster of claim 1 wherein the cleaning sleeve is sewn from a swatch of fabric to form a hollow sleeve.

7. The duster of claim 1 wherein the rod has a handle attached at one end thereof.

8. The duster of claim 7 wherein the cleaning sleeve has tabs or ribbons at one end near said handle.

9. The duster of claim 8 wherein the cleaning sleeve is attached to said rod near said handle by tying said tabs or ribbons together.

10. The duster of claim 7 wherein the cleaning sleeve is attached to said rod near said handle by a bow, tie or hook and loop material.

11. The duster of claim 7 wherein said handle and elongated rod are molded together to form a single unit.

12. The duster of claim 1 wherein the rod is made from a plastic material and said plastic material is acetal.

13. The duster of claim 1 wherein the cleaning sleeve is made from conventional cleaning or dusting material.

14. The duster of claim 1 wherein there is a handle molded at one end of said elongated rod to form a unitary unit therewith.

* * * * *